US010481534B2

(12) United States Patent
Katakura

(10) Patent No.: US 10,481,534 B2
(45) **Date of Patent: *Nov. 19, 2019**

(54) IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Hiroshi Katakura, Numazu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/892,065

(22) Filed: Feb. 8, 2018

(65) Prior Publication Data

US 2018/0231924 A1 Aug. 16, 2018

(30) Foreign Application Priority Data

Feb. 15, 2017 (JP) ..... 2017-026291
May 11, 2017 (JP) ..... 2017-094867

(51) Int. Cl.
*G03G 15/20* (2006.01)
*G03G 21/20* (2006.01)
*G03G 15/00* (2006.01)

(52) U.S. Cl.
CPC ..... *G03G 15/205* (2013.01); *G03G 15/2017* (2013.01); *G03G 15/2039* (2013.01); *G03G 15/6573* (2013.01); *G03G 21/206* (2013.01); *G03G 2215/2032* (2013.01); *G03G 2215/2041* (2013.01)

(58) Field of Classification Search
CPC ..... G03G 21/206; G03G 15/2017; G03G 15/2039
See application file for complete search history.

(56) References Cited

U.S. PATENT DOCUMENTS 8,380,114 B2 * 2/2013 Watanabe ..... G03G 15/2028 399/320
8,929,762 B2 1/2015 Shinagawa et al.
(Continued)

FOREIGN PATENT DOCUMENTS

JP 08036348 A * 2/1996
JP 2007078806 A * 3/2007 ..... B65H 29/58
(Continued)

*Primary Examiner* — Sevan A Aydin
(74) *Attorney, Agent, or Firm* — Kim & Stewart LLP

(57) ABSTRACT

An image forming apparatus includes a fixing device configured to fix a toner to a recording medium, a cooling device disposed so as to cool the fixing device with forced air, and a rotatable guide configured to guide the recording medium towards a first location when in a first position and towards a second location when in a second position. The rotatable guide partially blocks the forced air at the first position and forms a pathway for the forced air when at the second position. A control unit rotates the guide unit to the second position if an operating mode of the fixing device is changed from a first mode having a fixing temperature set point at a first temperature to a second mode having a fixing set point temperature lower than the first temperature.

19 Claims, 7 Drawing Sheets

(56) References Cited

U.S. PATENT DOCUMENTS

| | | | | |
|---|---|---|---|---|
| 2006/0051123 | A1* | 3/2006 | Awaya | G03G 15/6573 399/92 |
| 2006/0133865 | A1* | 6/2006 | Nakamura | G03G 15/6573 399/320 |
| 2007/0019981 | A1* | 1/2007 | Kawamata | G03G 15/6573 399/92 |
| 2007/0059022 | A1* | 3/2007 | Yamaoka | G03G 15/2017 399/92 |
| 2007/0059024 | A1* | 3/2007 | Kitayama | B65H 29/58 399/92 |
| 2008/0044213 | A1* | 2/2008 | Kato | G03G 15/6573 399/405 |
| 2014/0161481 | A1* | 6/2014 | Udagawa | G03G 21/206 399/92 |
| 2018/0129162 | A1* | 5/2018 | Takahashi | G03G 15/2017 |
| 2018/0321638 | A1* | 11/2018 | Takahashi | G03G 15/2017 |

FOREIGN PATENT DOCUMENTS

| | | | |
|---|---|---|---|
| JP | 2008298831 | A | * 12/2008 |
| JP | 2010266799 | A | * 11/2010 |
| JP | 2015184408 | A | 10/2015 |

* cited by examiner

IMAGE FORMING APPARATUS

CROSS-REFERENCE TO RELATED APPLICATION

The present application is based upon and claims the benefit of priorities from Japanese Patent Application No. 2017-026291 filed on Feb. 15, 2017 and Japanese Patent Application No. 2017-094867 filed on May 11, 2017, the entire contents of which are hereby incorporated by reference.

FIELD

Embodiments described herein relate generally to an image forming apparatus.

BACKGROUND

An image forming apparatus which can use a decolorable toner is known. The image forming apparatus of this type includes a fixing device that heats the decolorable toner to a first temperature for fixing the decolorable toner to a sheet when the image forming apparatus is in a decolorable toner printing mode. The fixing device heats the decolorable toner to a second temperature that is higher than the first temperature when decoloring the decolorable toner when the image forming apparatus is in a decoloring mode.

It is necessary to lower the temperature of the fixing device when switching to the decolorable toner fixing mode. Therefore, an image forming apparatus capable of efficiently cooling the fixing device is desirable.

DETAILED DESCRIPTION

In general, according to one embodiment, an image forming apparatus comprises a fixing device configured to fix a toner to a recording medium, such a paper sheet or the like. A cooling device is disposed so as to cool the fixing device with forced air. A rotatable guide is configured to guide the recording medium towards a first location when in a first position and towards a second location when in a second position. The rotatable guide partially blocks the forced air when in the first position and forms a pathway for the forced air between the cooling device and the fixing device when at the second position. A control unit is configured to rotate the guide unit to the second position if an operating mode of the fixing device is changed from a first mode in which the fixing unit has a set point temperature at a first temperature to a second mode in which the fixing unit has a set point temperature at a second temperature that is lower than the first temperature.

Hereinafter, an image forming apparatus of an example embodiment will be described with reference to the drawings. In the present disclosure, XYZ directions are defined as follows. The Z direction is a vertical direction and the X direction and the Y direction are horizontal directions. The Z direction is the upward and downward direction (height direction) of the image forming apparatus and a +Z direction is the upward direction. The X direction is a forward and rearward direction (depth direction) of the image forming apparatus and a +X direction is the forward direction. The Y direction is a rightward and leftward direction (width direction) of the image forming apparatus.

Figure 1:
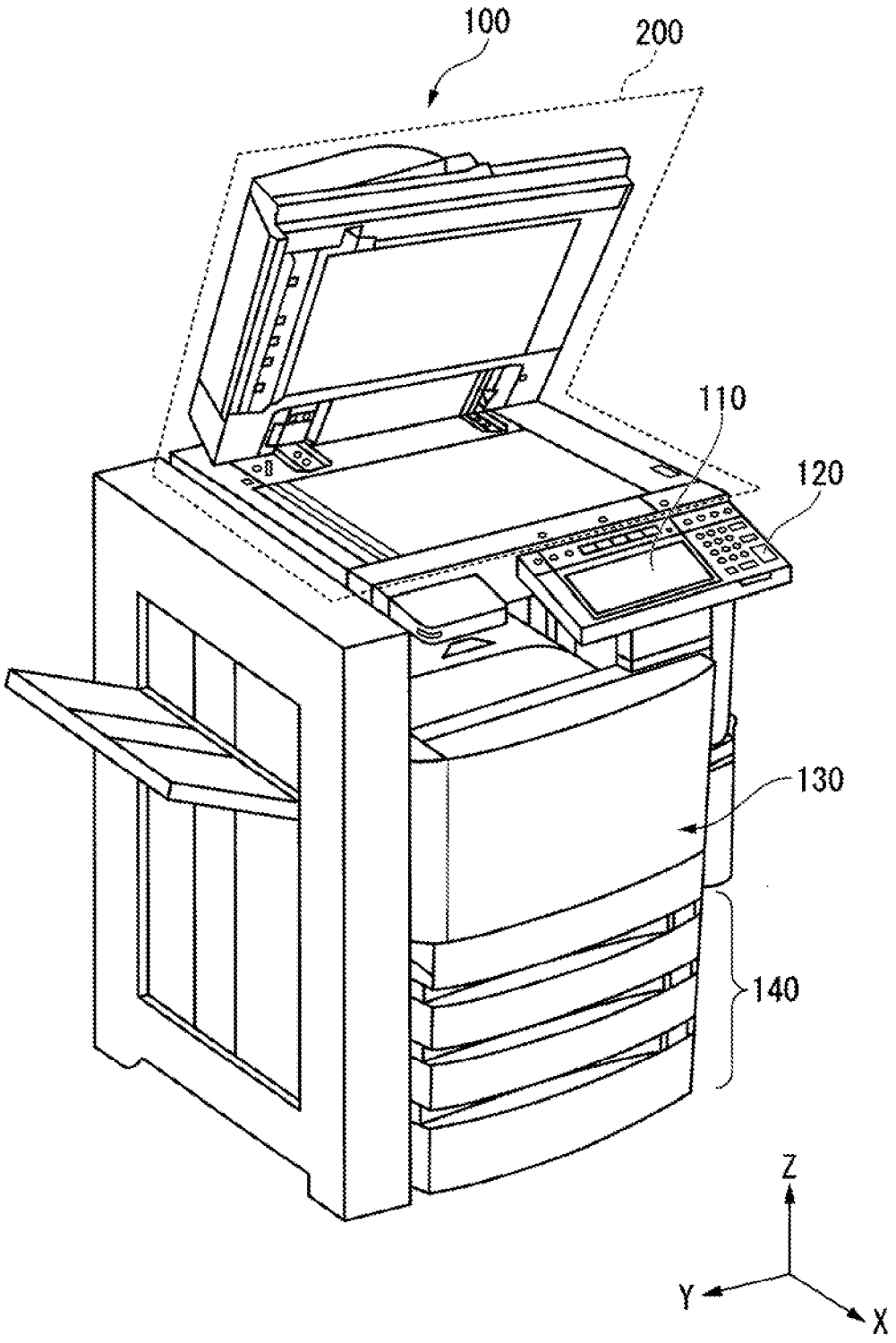
FIG. 1 is a perspective view of an image forming apparatus according to an embodiment.

FIG. 1 is a perspective view of the image forming apparatus of an embodiment. For example, an image forming apparatus 100 is a multifunctional peripheral machine. The image forming apparatus 100 includes a display 110, a control panel 120, an image reading unit 200, a printer unit 130, and a sheet storage unit 140.

The image forming apparatus 100 forms an image on a sheet (recording medium) using a recording agent. The sheet is, for example, paper or a label sheet. A specific example of the recording agent is a toner. The toner can be a decolorable toner, used as a decolorable recording agent, or a non-decolorable toner, used as a non-decolorable recording agent.

The decolorable toner decolors with the application of energy from the outside. Application of energy from the outside means that an external stimulus such as heating, exposure to light having a specific wavelength, application of pressure, or the like. The term "decoloring" in the embodiment refers to causing an image initially formed with a visible color (any color, inclusive of white and black or any color different from a color of the background on which it is formed) to become substantially invisible to ordinary perception.

The display 110 is an image display device such as a liquid crystal display, or an organic electro luminescence (EL) display. The display 110 displays various kinds of information related to the image forming apparatus 100.

The control panel 120 has a plurality of buttons. The control panel 120 receives inputs and operation selections of a user. The control panel 120 receives an instruction for performing a printing job using the decolorable toner or a printing job by the non-decolorable toner. The control panel 120 receives an instruction of the decoloring job of a sheet printed by the decolorable toner. The control panel 120 outputs a signal corresponding to an input from the user to an image forming control unit 50 (see FIG. 3) of the image forming apparatus 100. In some examples, the display 110 and the control panel 120 may be configured as an integrated touch panel.

The image reading unit 200 reads image information from a sheet by scanning or the like. The image reading unit 200 records the image information that is read.

The printer unit 130 forms an image on a sheet based on image information generated by the image reading unit 200 or image information received via a communication path or network connection. In some examples, the printer unit 130 forms an image by a process as follows. An image forming unit of the printer unit 130 forms an electrostatic latent image on a photoconductive drum based on the input/received image information. The image forming unit of the printer unit 130 forms a visible image by attaching a developer to the electrostatic latent image. A transfer unit of the printer unit 130 transfers the visible image onto a sheet. A fixing device of the printer unit 130 fixes the visible image to the sheet by heating and pressing. The sheet on which an image is formed may be a sheet that was stored in the sheet storage unit 140 or may be a sheet fed by hand by a user.

The sheet storage unit 140 stores sheets used printing in the printer unit 130. Sheets to be decolored (sheets having a decolorable toner image formed thereon) can be stored in the storage unit 140 or may be fed by hand by a user. The user instructs the decoloring job of a sheet or sheets using the control panel 120. Upon receiving this instruction, the image formed on the sheet with decolorable toner is decolored and the processed (decolored) sheet is output.

Figure 2:
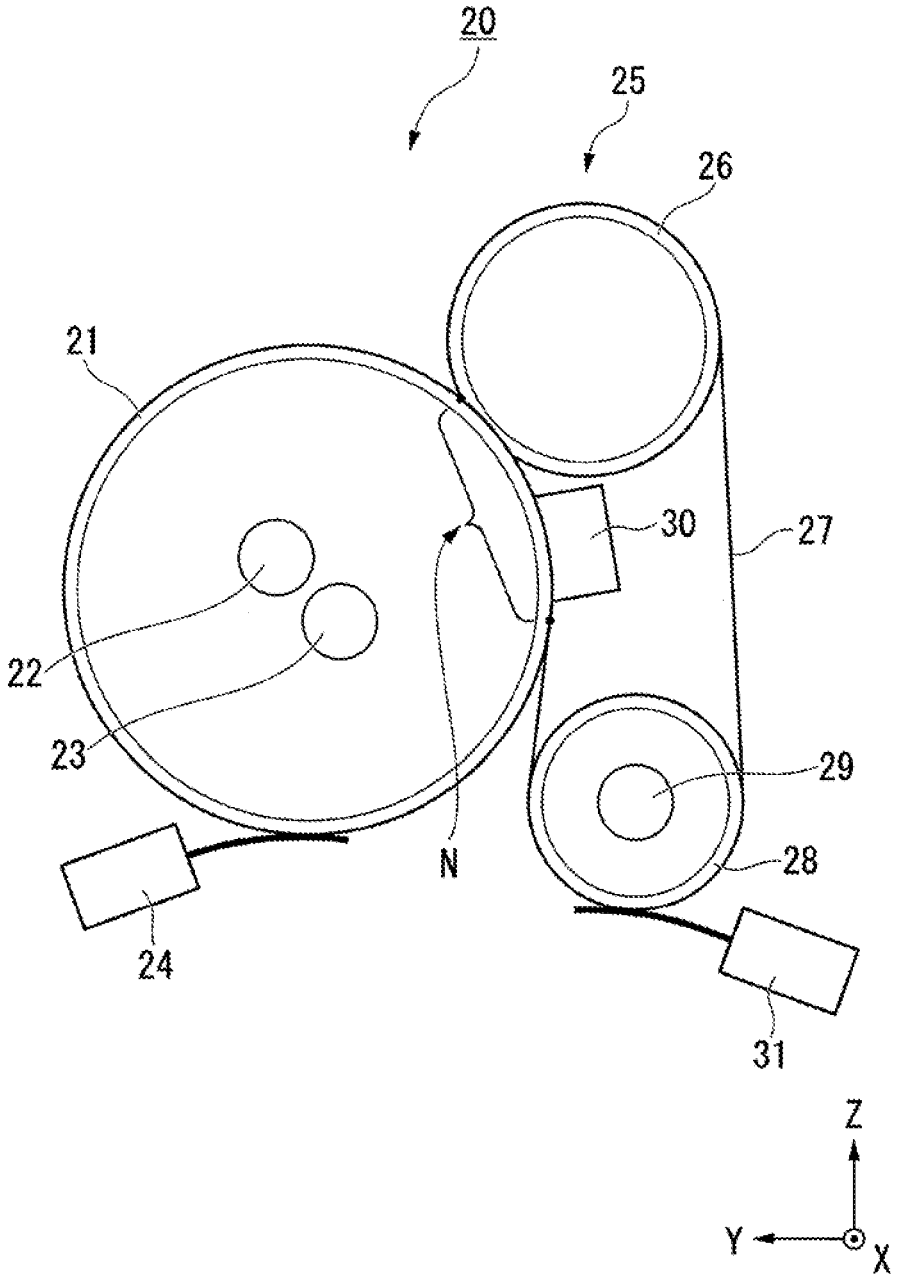
FIG. 2 is a cross-sectional view illustrating a schematic configuration of a fixing device.

FIG. 2 is a cross-sectional view illustrating a schematic configuration of a fixing device 20. A fixing device 20 is capable of fixing the decolorable toner and the non-decolorable toner. The fixing device 20 is also capable of decoloring the decolorable toner. The fixing device 20 includes a heat roller 21, an HR thermistor 24, a pressure belt unit 25, and a pressure belt thermistor 31. In some contexts, the heat roller 21 may also be referred to as HR 21, a heating roller 21, or a fixing roller 21. The HR thermistor 24 and the pressure belt thermistor 31 may also be referred to as temperature sensors.

The heat roller 21 includes a cylindrical base body formed of aluminum or the like. An outer peripheral surface of the heat roller 21 is covered by a release layer. The release layer is a fluoropolymer coating layer. The release layer may be an elastic layer, a tetrafluoroethylene perfluoroalkyl vinyl ether copolymer (PFA) tube, or the like. The heat roller 21 incorporates an HR center lamp 22 and an HR side lamp 23 as heating elements. For example, the HR center lamp 22 and the HR side lamp 23 are halogen lamps. The HR center lamp 22 heats a center portion (along an axial direction (X direction)) of the heat roller 21. The HR side lamp 23 heats both end portions in the axial direction (X direction) of the heat roller 21.

The HR thermistor 24 detects a temperature of the heat roller 21.

The pressure belt unit 25 includes a pressure belt 27, an outlet pressure roller 26, a pressure belt heat roller 28, and a nip pad 30.

The pressure belt 27 is an endless belt (a loop). The pressure belt 27 is wound around the outlet pressure roller 26 and the pressure belt heat roller 28.

The outlet pressure roller 26 is formed by bonding a solid rubber or the like to a periphery of a core metal formed of stainless used steel (SUS) or the like. The outlet pressure roller 26 is pressurized toward the heat roller 21 by a pressurizing mechanism (not illustrated).

The pressure belt heat roller 28 includes a cylindrical base body formed of aluminum or the like. The outer peripheral surface of the pressure belt heat roller 28 is coated by the release layer. The pressure belt heat roller 28 incorporates a pressure belt lamp 29 as a heating element. For example, the pressure belt lamp 29 is a halogen lamp. Heat is transmitted from the heated pressure belt heat roller 28 so that the pressure belt 27 is heated.

The nip pad 30 is formed by bonding silicon rubber or the like to sheet metal. The nip pad 30 presses the pressure belt 27 against the outer peripheral surface of the heat roller 21 from an inside of the pressure belt 27 by an independent pressing mechanism (not illustrated). The pressure belt 27 and the heat roller 21 are in pressed contact by the nip pad 30. A slipping sheet for friction reduction may be provided between the nip pad 30 and the pressure belt 27.

The pressure belt thermistor 31 detects a temperature of the pressure belt 27. The pressure belt thermistor 31 is disposed at a center portion in the width direction of the pressure belt 27.

A nip N is formed at a contact portion between the outer peripheral surface of the heat roller 21 and the outer peripheral surface of the pressure belt 27. A sheet and a toner on the sheet are heated and pressurized through the nip N formed between the heat roller 21 and the pressure belt 27. The sheet passing through the nip N is heated on both sides by the heat roller 21 and the pressure belt 27 and the toner is fixed to the sheet.

Figure 3:
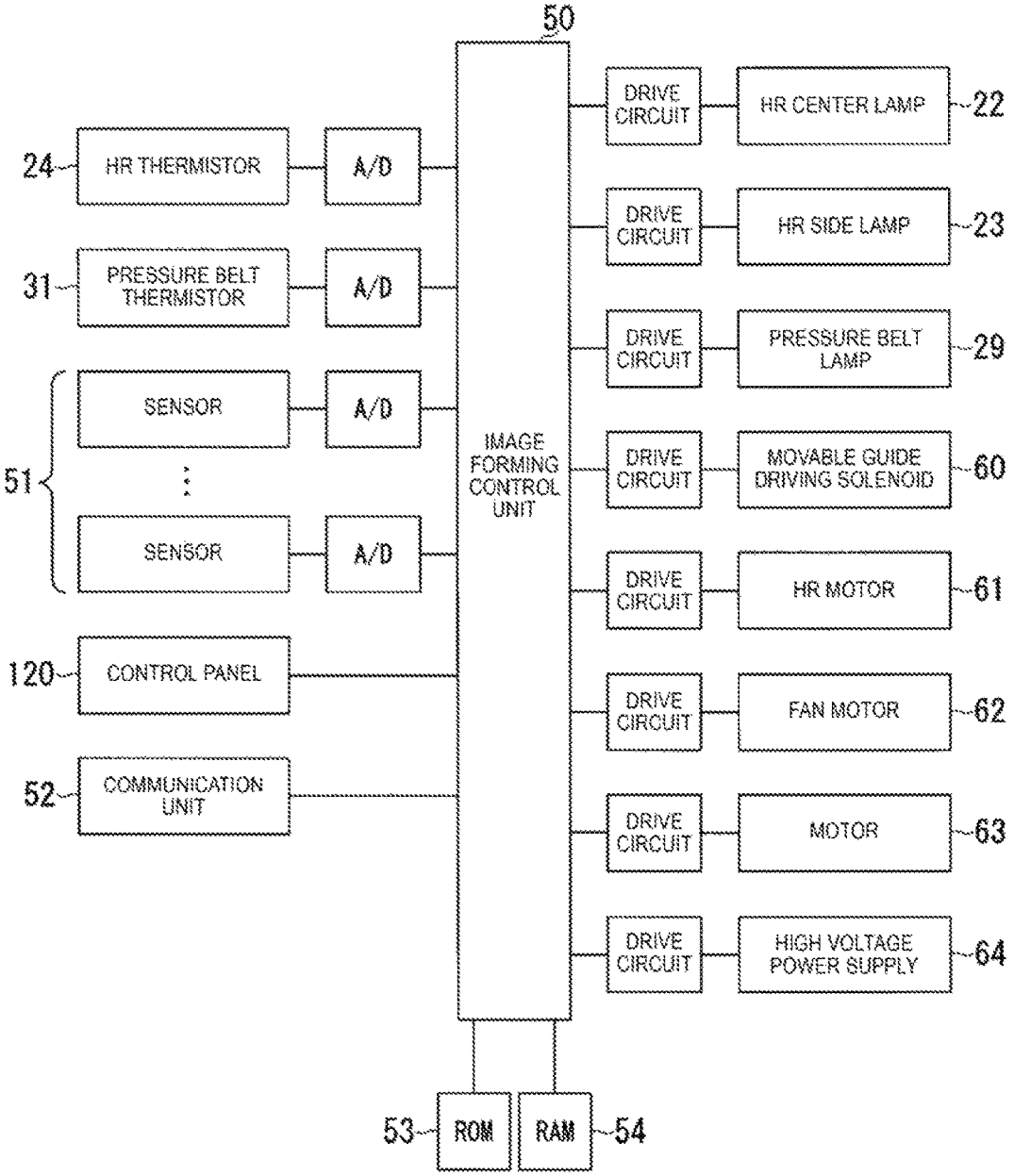
FIG. 3 is a block diagram illustrating a functional configuration of the image forming apparatus according to the embodiment.

FIG. 3 is a block diagram illustrating operational configuration aspect of the image forming apparatus 100 according to an embodiment. The image forming control unit 50 (hereinafter "control unit 50" for simplicity) has a central processing unit (CPU). The control unit 50 controls operations of the image forming apparatus 100 including temperature control of the fixing device 20.

Input devices connected to the control unit 50 are the HR thermistor 24, the pressure belt thermistor 31, sensors 51, the control panel 120, and a communication unit 52. The HR thermistor 24, the pressure belt thermistor 31, and the various sensors 51 output signals to the control unit 50 via an analog-to-digital (A/D) converter.

The HR thermistor 24 outputs a signal indicating a surface temperature of the heat roller 21 to the control unit 50. The pressure belt thermistor 31 outputs a signal indicating a surface temperature of the pressure belt 27 to the control unit 50. The various sensors 51 measure assorted physical parameters used for controlling image formation. The various sensors 51 output signals indicating these measured physical parameters to the control unit 50.

The control panel 120 outputs a signal indicating an instruction from the user received via the control panel 120 to the control unit 50. For example, the control panel 120 outputs an instruction for starting a printing job to the control unit 50. In this case, the control unit 50 controls operations so as to form an image based on the instruction of the printing job by the user.

The communication unit 52 performs communication with an external device. The communication unit 52 may perform wired communication with the external device or may perform wireless communication. The external device is, for example, an information terminal, such as a computer. The communication unit 52 receives a signal indicating an instruction from the user has been received by the external device and outputs this signal to the control unit 50.

Output devices connected to the control unit 50 are the HR center lamp 22, the HR side lamp 23, the pressure belt lamp 29, a movable guide driving solenoid 60, an HR motor 61, a fan motor 62, a motor 63, and a high voltage power supply 64. The control unit 50 controls an operation of each output device via a drive circuit. The drive circuit includes a switching circuit, a digital/analog (D/A) converter, or the like.

For example, the control unit 50 controls the temperature of the heat roller 21 by controlling a light ON/OFF time or a power amount of the HR center lamp 22 and the HR side lamp 23. For example, the control unit 50 controls the temperature of the pressure belt 27 by controlling a light ON/OFF time or a power amount of the pressure belt lamp 29.

The movable guide driving solenoid 60 switches a movable guide 40 between a first position and a second position. The HR motor 61 rotates the heat roller 21 of the fixing device 20. The pressure belt 27 is driven by the rotation of the heat roller 21. The fan motor 62 rotates a fan 70.

A ROM 53 is connected to the control unit 50. The ROM 53 stores a control program, control data, or the like. A RAM 54 is connected to the control unit 50. The RAM 54 stores a control parameter, operation data of the image forming apparatus 100, or the like. For example, the RAM 54 stores the number of printed sheets that have been processed.

Figure 4:
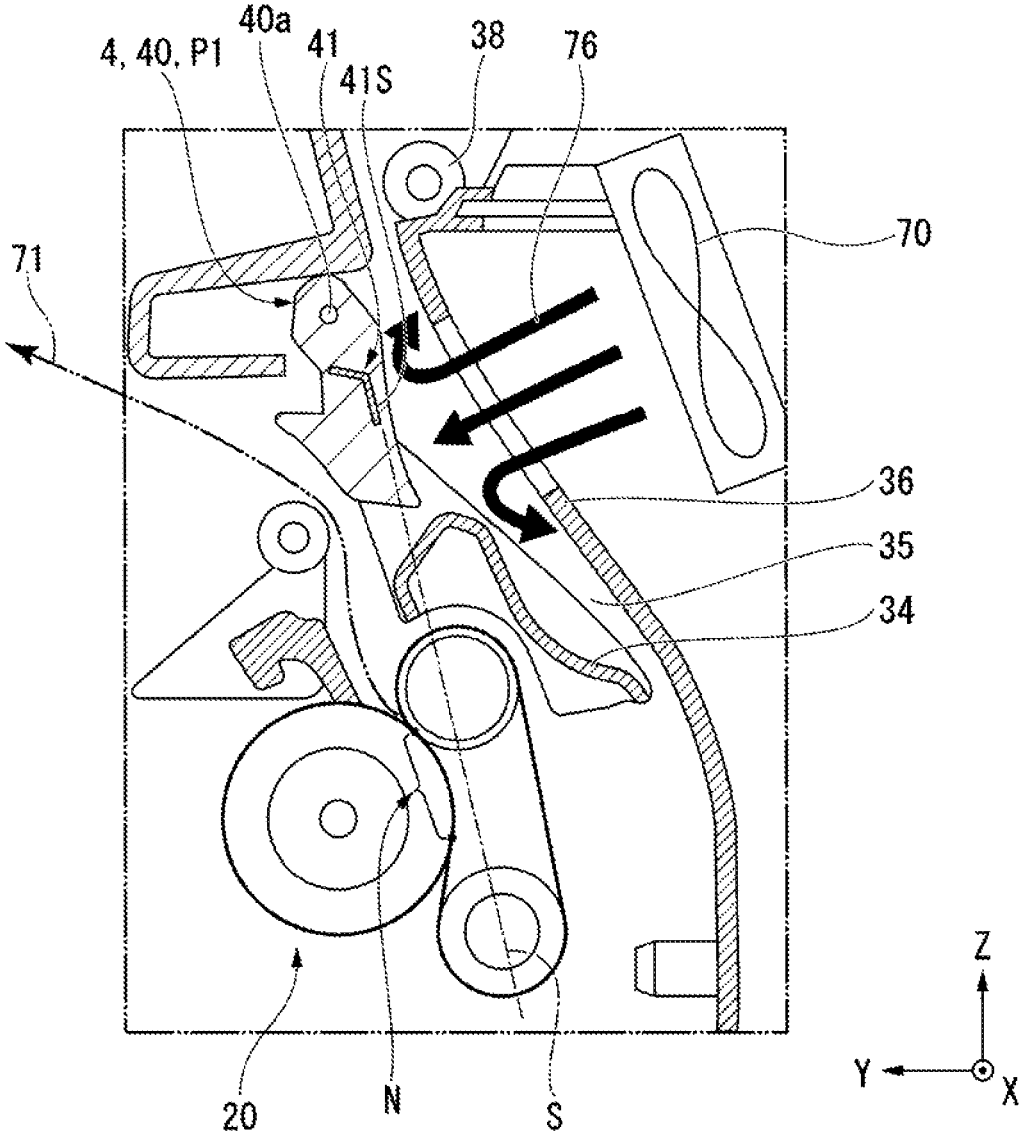
FIG. 4 is a cross-sectional view of a periphery of the fixing device in a state where a movable guide is disposed at a first position.

FIG. 4 is a cross-sectional view of a periphery of the fixing device in a state where the movable guide 40 is disposed at the first position. The image forming apparatus 100 includes a fixing guide 34, a guide unit 4, a reverse carrying guide 36, a carrying roller 38, and a fan 70 near the fixing device 20. The guide unit 4 may also be referred to as a gate and is includes the movable guide 40 and the movable guide driving solenoid 60 (see FIG. 3).

The fixing guide 34 and the movable guide 40 guide the sheet to be carried. The fixing guide 34 and the movable guide 40 are disposed in this order on a downstream side of the fixing device 20 along a sheet carrying direction (simply, referred to as a carrying direction). The movable guide 40 is disposed between the fixing device 20 and the fan 70.

Figure 6:
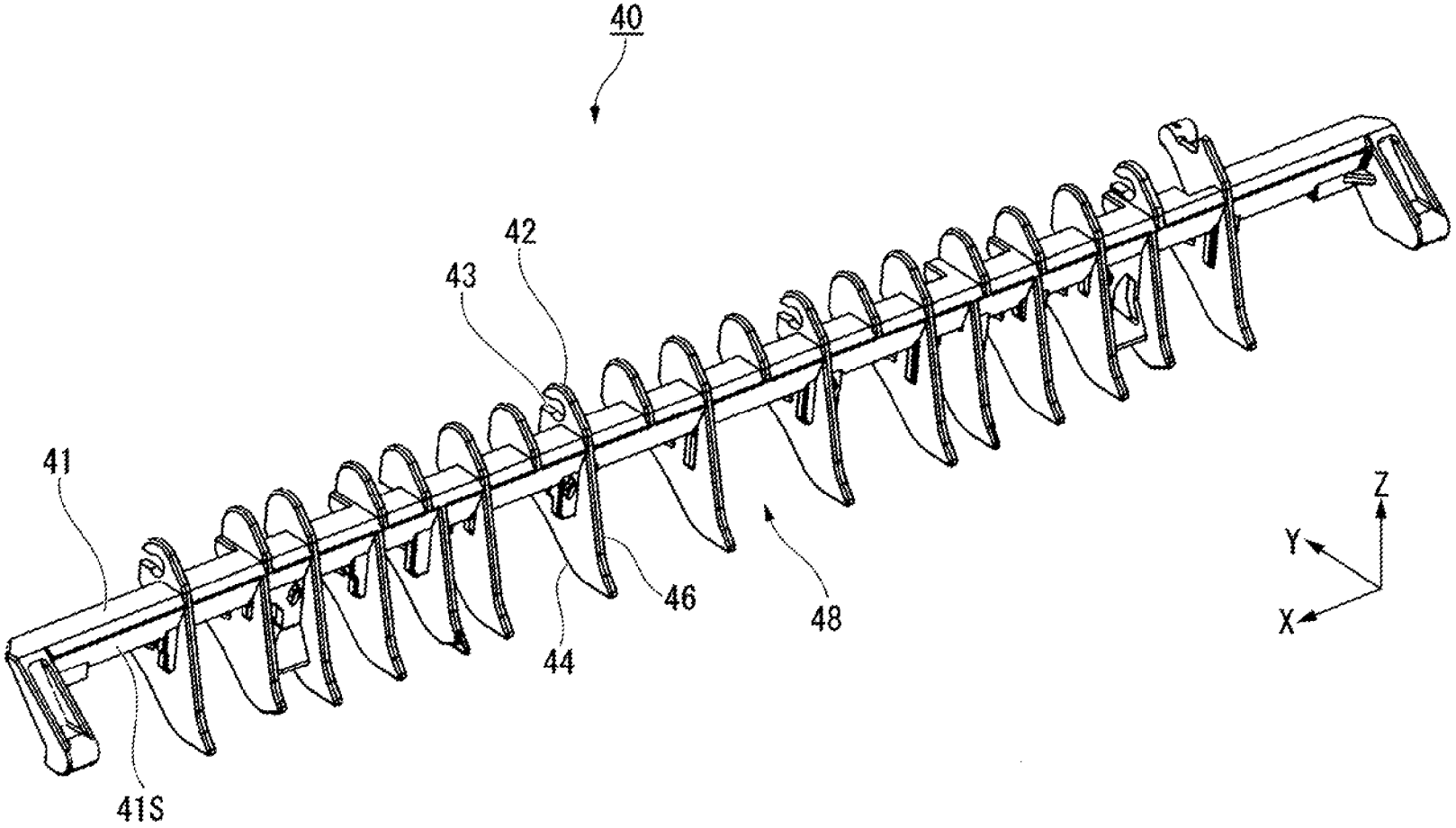
FIG. 6 is a perspective view of the movable guide.

FIG. 6 is a perspective view of the movable guide 40. The movable guide 40 is formed of a resin material or the like. The movable guide 40 includes guide blades 42 and a connecting bar 41.

Each guide blade 42 is formed in a plate shape in which the X direction is a thickness direction. A notch 43 is formed at an upper end portion of the guide blade 42. A rotation shaft 40*a* (see FIG. 4) is inserted into the notch 43. A first guide unit 44 is formed at a peripheral edge portion of the guide blade 42 in the +Y direction. The first guide unit 44 forms a first carrying path 71 (see FIG. 4) of the sheet. A second guide unit 46 is formed at a peripheral edge portion of the guide blade 42 in the −Y direction. The second guide unit 46 forms a second carrying path 72 (see FIG. 5) of the sheet. A plurality of guide blades 42 are disposed side by side along the X direction.

The connecting bar 41 is formed in a bar shape extending in the X direction. The connecting bar 41 is connected to a center portion of the plurality of the guide blades 42. The connecting bar 41 is driven by the movable guide driving solenoid 60 (see FIG. 3). The connecting bar 41 rotates the movable guide 40 around the rotation shaft 40*a* (see FIG. 4). An airflow direction changing surface 41S is formed in the −Y direction of the connecting bar 41. As illustrated in FIG. 4, the −Y direction of the connecting bar 41 is on the same side as the fan 70 as viewed from the connecting bar 41. The airflow direction changing surface 41S changes the direction of the air blown out from the fan 70. The airflow direction changing surface 41S is formed in a planar shape.

The movable guide 40 has a shape similar to that of a comb with teeth (guide blades 42) extending from the connecting bar 41. The movable guide 40 includes a comb-teeth unit 48 on a lower side.

As illustrated in FIG. 4, the movable guide 40 is capable of rotating around the rotation shaft 40*a* at the upper end portion. Therefore, the movable guide 40 is capable of switching between a first position P1 and a second position P2 (see FIG. 5). The movable guide 40 is maintained at the first position P1 by a spring loading (not illustrated). The control unit 50 moves the movable guide 40 to the second position P2 (see FIG. 5) against this spring force by operating the movable guide driving solenoid 60 (see FIG. 3). In FIG. 4, the movable guide 40 is at the first position P1. The first position P1 is a position at for causing the sheet to move in a direction along the sheet carrying path towards a sheet discharge tray of the image forming apparatus 100. At the first position P1, the comb-teeth of the movable guide 40 on the lower side meshes with comb-teeth of the fixing guide 34 on the upper side. Thus, there is not a large gap is formed between the movable guide 40 and the fixing guide 34. The first carrying path 71 of the sheet is formed in the +Y direction of the movable guide 40. The sheet sent out from the fixing device 20 is carried through the first carrying path 71 and is discharged to the sheet discharge tray of the image forming apparatus 100.

When the movable guide 40 is at the first position P1, an extension surface S of the airflow direction changing surface 41S is disposed at the nip N of the fixing device 20 in the −Y direction. The −Y direction of the nip N is on the same side as the fan 70 as viewed from the nip N. The extension surface S of the airflow direction changing surface 41S is a surface extending around the airflow direction changing surface 41S including the airflow direction changing surface 41S.

The reverse carrying guide 36 is disposed at a predetermined interval with the fixing guide 34 and the movable guide 40 in the −Y direction. A reverse carrying path 35 is formed between the reverse carrying guide 36, the fixing guide 34, and the movable guide 40. The reverse carrying path 35 carries the sheet so that an image is formed on a rear surface of the sheet.

The carrying roller 38 is disposed at an upper end portion of the reverse carrying path 35.

Figure 5:
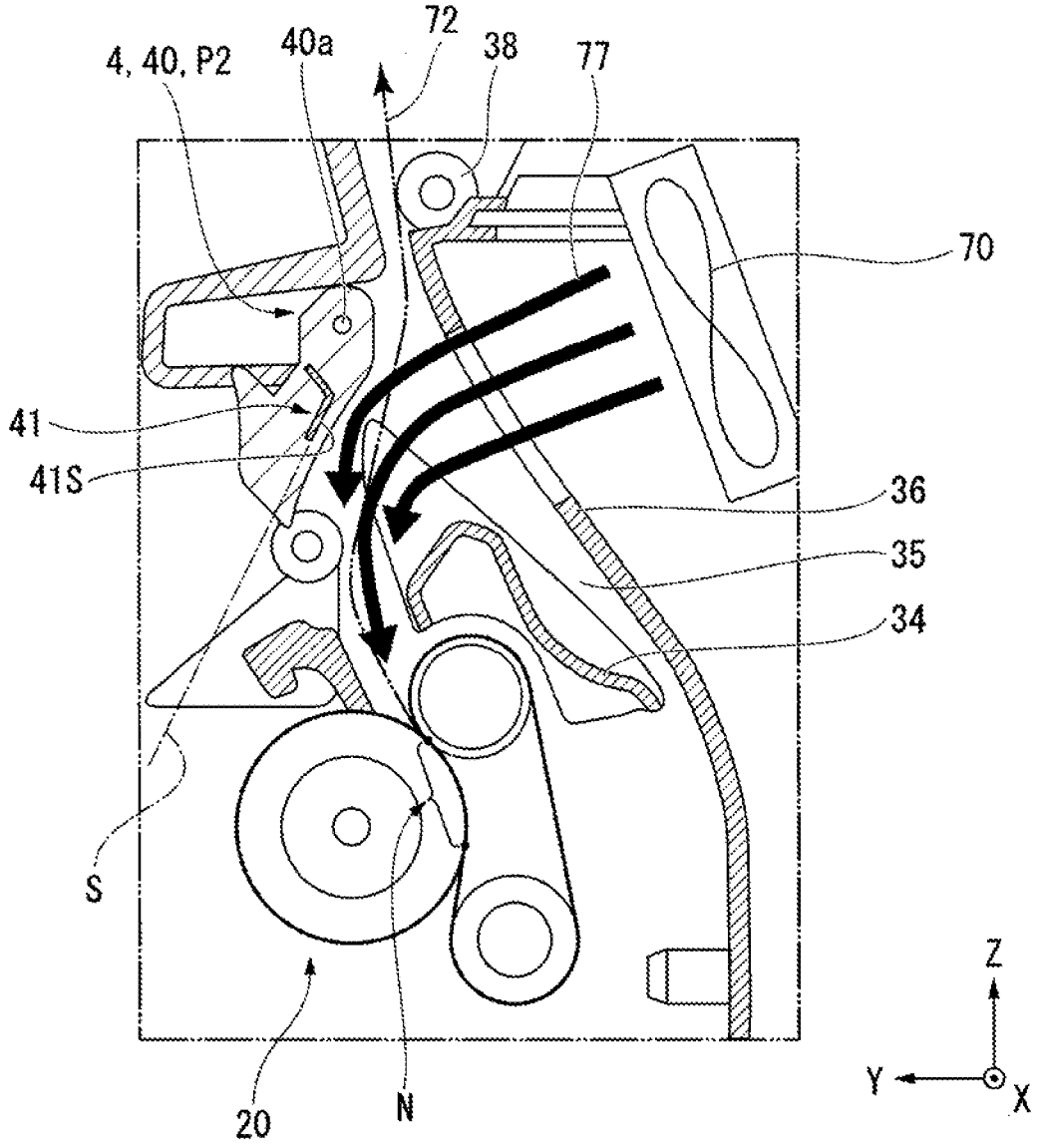
FIG. 5 is a cross-sectional view of the periphery of the fixing device in a state where the movable guide is disposed at a second position.

FIG. 5 is a cross-sectional view of the periphery of the fixing device in a state where the movable guide is disposed at the second position. In FIG. 5, the movable guide 40 is at the second position P2. The second position P2 is a position at which the discharge direction of the sheet is a direction of a post-processing apparatus if the post-processing apparatus (not illustrated) is attached to the image forming apparatus 100. At the second position P2, the movable guide 40 is disposed so as to traverse the first carrying path 71 illustrated in FIG. 4. A large gap is formed between the movable guide 40 and the fixing guide 34. The second carrying path 72 is formed in the −Y direction of the movable guide 40. The sheet sent out from the fixing device 20 is carried to the second carrying path 72 and reaches the carrying roller 38. The carrying roller 38 discharges the sheet to the post-processing apparatus. The carrying roller 38 can also reverse an advancing direction of the sheet and allow the sheet to enter the reverse carrying path 35.

When the movable guide 40 is at the second position P2, the extension surface S of the airflow direction changing surface 41S is disposed in the +Y direction of the nip N of the fixing device 20. The +Y direction of the nip N is a side opposite to the fan 70 as viewed from the nip N.

The fan 70 takes in air from outside of the image forming apparatus 100 and blows air into the inside of the image forming apparatus 100. The fan 70 is disposed in the −Y direction of the reverse carrying guide 36. The fan 70 cools the fixing device 20 (particularly, the heat roller 21) with forced air.

Figure 7:
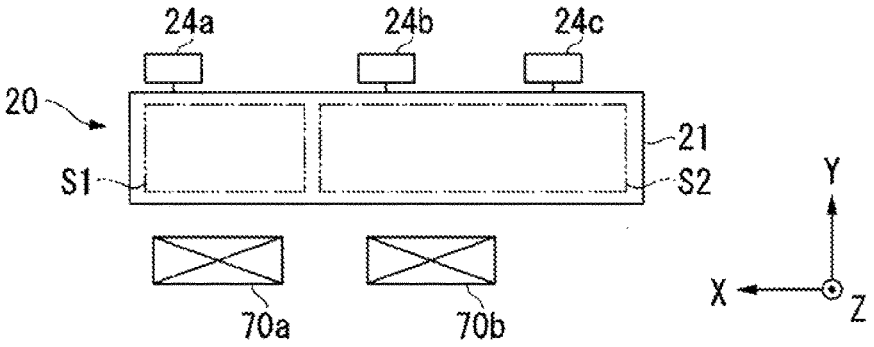
FIG. 7 is a plan view illustrating a positional relationship between a fan and an HR thermistor with respect to a heat roller.

FIG. 7 is a plan view illustrating a positional relationship between the fan and the HR thermistor with respect to the heat roller.

The image forming apparatus 100 includes a first fan 70*a* and a second fan 70*b*. The first fan 70*a* is disposed at a position in the X direction corresponding to an end portion of the heat roller 21 in the +X direction. The first fan 70*a* cools an end portion (first portion S1) of the heat roller 21 in the +X direction. The second fan 70*b* is disposed at a position in the X direction corresponding to a center portion and an end portion of the heat roller 21 in the −X direction. The second fan 70*b* cools the center portion and the end portion (second portion S2) of the heat roller 21 in the −X direction.

The fixing device 20 includes a first HR thermistor 24*a*, a second HR thermistor 24*b*, and a third HR thermistor 24*c*. The first HR thermistor 24*a* is in contact with the end portion of the heat roller 21 in the +X direction to detect a temperature. The first HR thermistor 24*a* detects the temperature of the first portion S1 of the heat roller 21. The second HR thermistor 24*b* is in contact with the center portion of the heat roller 21 in the X direction to detect a temperature. The third HR thermistor 24*c* is in contact with the end portion of the heat roller 21 in the −X direction to detect a temperature. The second HR thermistor 24*b* and the third HR thermistor 24*c* detect the temperature of the second portion S2 of the heat roller 21.

Figure 8:
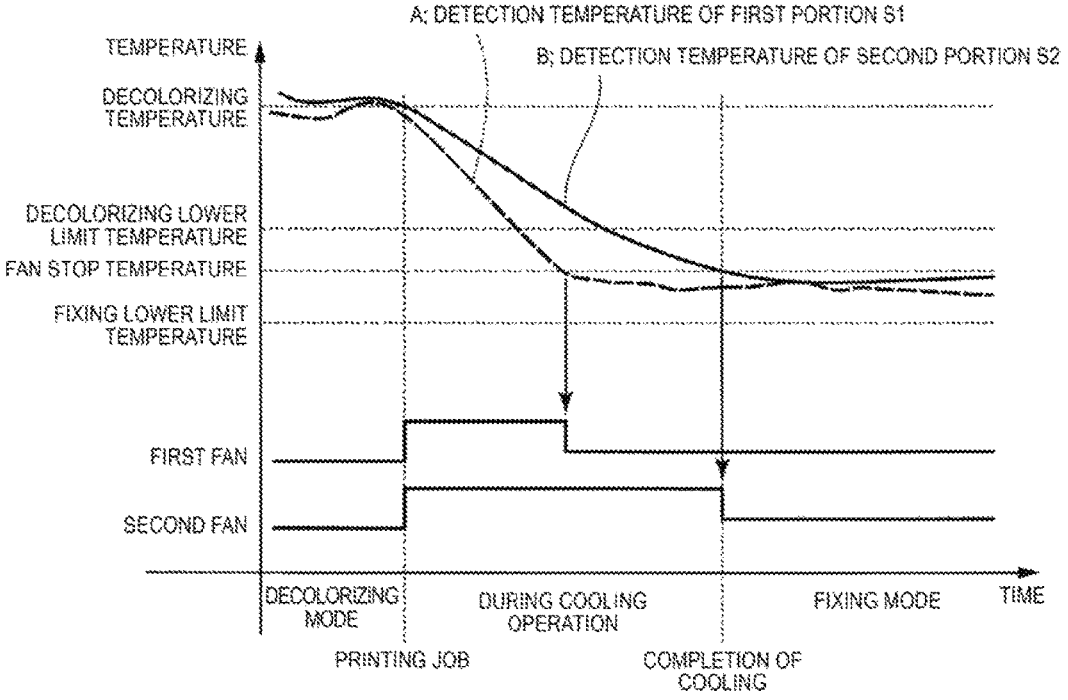
FIG. 8 is a graph illustrating a relationship between an operation of a cooling device and a temperature detected by the HR thermistor.

FIG. 8 is a graph illustrating a relationship between an operation of the cooling device and a detection temperature of the HR thermistor. FIG. 8 illustrates a case where the image forming apparatus 100 is transferred from a mode (referred to as a decolorable toner decoloring mode) for performing decoloring of the decolorable toner to a mode (referred to as a decolorable toner fixing mode) for performing fixing of the decolorable toner. A horizontal axis of FIG. 8 is a time. A vertical axis of FIG. 8 is a detection temperature of the HR thermistor 24 and a drive signal of the fan 70. A graph B of the detection temperature of the second portion S2 indicates the detection temperature of the HR thermistor 24 which becomes a high temperature in the second HR thermistor 24*b* and the third HR thermistor 24*c*. The detection temperature of the pressure belt thermistor 31 is equal to the detection temperature of the HR thermistor 24.

When the user instructs the decoloring job of the decolorable toner from the control panel 120 (see FIG. 1), the image forming apparatus 100 executes the decolorable toner decoloring mode. The image forming apparatus 100 decolors an image of the decolorable toner formed on the sheet. The image forming apparatus 100 carries the sheet to the fixing device 20 and heats the decolorable toner to a decoloring temperature to decolor the image.

Next, when the user instructs the printing job of the decolorable toner from the control panel 120, the image forming apparatus 100 executes the decolorable toner fixing mode. The image forming apparatus 100 forms an image on the sheet by the decolorable toner and then carries the sheet to the fixing device 20. The image forming apparatus 100 heats the decolorable toner to the fixing temperature and fixes the decolorable toner to the sheet. In general, the fixing temperature is lower than the decoloring temperature.

In FIG. 8, the image forming apparatus 100 initially executes the decolorable toner decoloring mode. In this case, the control unit 50 sets the temperature of the heat roller 21 to the decoloring temperature. Next, when the printing job is instructed, the control unit 50 turns on the drive signals of the first fan 70*a* and the second fan 70*b*. Therefore, air is blown out from the first fan 70*a* and the second fan 70*b*, and a cooling operation of the fixing device 20 is started. The control unit 50 rotates the heat roller 21 when the fixing device 20 is cooled. The heat roller 21 rotates to be cooled. Therefore, the image forming apparatus 100 is capable of efficiently cooling the fixing device 20.

The position of the movable guide 40 in the decolorable toner decoloring mode immediately before the cooling operation is determined by an instruction of the sheet discharge direction in the decoloring job. Therefore, as illustrated in FIG. 4, immediately preceding decolorable toner decoloring mode may be carried out by disposing the movable guide 40 at the first position P1. A large interval is not formed between the movable guide 40 that is at the first position P1 and the fixing guide 34. In this state, when the cooling operation is executed, forced air 76 blown out from the fan 70 is blocked by the movable guide 40 and the fixing guide 34. When the movable guide 40 is at the first position P1, the extension surface S of the airflow direction changing surface 41S is disposed in the −Y direction of the nip N. The forced air 76 hits the airflow direction changing surface 41S, changes a course thereof, and flows in the −Y direction of the extension surface S. Therefore, it is less likely for the forced air 76 to reach the fixing device 20 and the cooling efficiency of the fixing device 20 is lowered.

As illustrated in FIG. 5, the control unit 50 disposes the movable guide 40 at the second position P2. The control unit 50 outputs the drive signal to the movable guide driving solenoid 60 (see FIG. 3) and moves the movable guide 40 to the second position P2 (see FIG. 5). Moreover, also when immediately preceding decolorable toner decoloring mode is executed by disposing the movable guide 40 at the second position P2, similarly, the control unit 50 outputs the drive signal.

The second position P2 is a position at which forced air 77 blown out from the fan 70 is guided to the fixing device 20. A large gap is formed between the movable guide 40 that is at the second position P2 and the fixing guide 34. Therefore, the forced air 77 blown out from the fan 70 passes through the gap between the movable guide 40 and the fixing guide 34. When the movable guide 40 is at the second position P2, the extension surface S of the airflow direction changing surface 41S is disposed in the +Y direction of the nip N. The forced air 76 hits the airflow direction changing surface 41S, changes a course thereof, and flows toward the fixing device 20 in the −Y direction of the extension surface S. Furthermore, the forced air 77 passes through a space in the +Y direction of the fixing guide 34 and reaches the fixing device 20. Therefore, the fixing device 20 is efficiently cooled.

As illustrated in FIG. 8, the decolorable toner fixing mode is carried out by holding the fixing device 20 at a printing temperature which is lower than the decoloring lower limit temperature and higher than the fixing lower limit temperature.

The image forming apparatus 100 cools the fixing device 20 by the first fan 70*a* and the second fan 70*b*. In this case, a temperature distribution may be formed on the heat roller 21. In FIG. 8, a temperature decreasing rate of the temperature of the first portion S1 indicated by a graph A is fast and a temperature decreasing rate of the temperature of the second portion S2 indicated by a graph B is slow. When the temperature of the first portion S1 is lower than the decoloring lower limit temperature, the temperature of the second portion S2 still exceeds the decoloring lower limit temperature. If the cooling by the first fan 70*a* and the second fan 70*b* is continued until the temperature of the second portion S2 is lower than the decoloring lower limit temperature, the temperature of the first portion S1 may be lower than the fixing lower limit temperature.

Therefore, when the temperature of the first portion S1 is lower than the fan stop temperature, the control unit 50 stops only the operation of the first fan 70*a*. A fan stop temperature is set to a temperature lower than the decoloring lower limit temperature and higher than the fixing lower limit temperature. The first fan 70*a* cools the first portion S1 of the fixing device 20. Lowering of the temperature of the first portion S1 is stopped by stopping the operation of the first fan 70*a*. Therefore, the temperature of the first portion S1 is maintained at a temperature lower than the decoloring lower limit temperature and higher than the fixing lower limit temperature.

When the temperature of the first portion S1 is lower than the fan stop temperature, the temperature of the second portion S2 is higher than the decoloring lower limit temperature. The control unit 50 continues the operation of the second fan 70*b* even when the temperature of the first portion S1 is lower than the fan stop temperature. The second fan 70*b* cools the second portion S2 of the fixing device 20. Therefore, lowering of the temperature of the second portion S2 continues.

Therefore, the temperature of the second portion S2 is lowered to a temperature lower than the decoloring lower limit temperature.

The control unit 50 stops the operation of the second fan 70*b* when the temperature of the second portion S2 is lower than the fan stop temperature. Lowering of the temperature of the second portion S2 is stopped by stopping the operation of the second fan 70*b*. Therefore, the temperature of the second portion S2 is maintained at a temperature lower than the decoloring lower limit temperature and higher than the fixing lower limit temperature.

After the temperature of the entire fixing device 20 is lower than the decoloring lower limit temperature and higher than the fixing lower limit temperature, the image forming apparatus 100 executes the decolorable toner fixing mode. The position of the movable guide 40 in the decolorable toner fixing mode is switched in accordance with the instruction in the sheet discharge direction in the printing job.

As described above, the image forming apparatus 100 of the embodiment includes the fixing device 20, the fan 70, the movable guide 40, and the control unit 50. The fixing device 20 fixes the decolorable toner for forming an image, to the sheet. The fan 70 blows out air to cool the fixing device 20. The movable guide 40 is rotatable and guides the sheet to be carried. The control unit 50 disposes the movable guide 40 at the second position P2 at which the air blown out from the fan 70 is guided to the fixing device 20.

Therefore, the forced air 77 blown out from the fan 70 reaches the fixing device 20 without the course being blocked or substantially obstructed. Therefore, the image forming apparatus 100 can efficiently cool the fixing device 20.

The movable guide 40 is rotatable, guides the sheet to be carried, and changes the direction of the air blown out from the fan 70. The control unit 50 rotates the movable guide 40 to the first position P1 and the second position P2. The cooling efficiency of the fixing device 20 at the second position P2 is higher than that at the first position P1.

The image forming apparatus 100 can efficiently cool the fixing device 20 by rotating the movable guide 40 to the second position P2. Moreover, even when the movable guide 40 is rotated to the first position P1, and even when the movable guide 40 is rotated between the first position P1 and the second position P2, the image forming apparatus 100 can cool the fixing device 20 to a certain extent.

The movable guide 40 includes the airflow direction changing surface 41S that changes the direction of the air blown out from the fan 70. The airflow direction changing surface 41S is formed so that the extension surface S of the airflow direction changing surface 41S is disposed on the same side as the fan 70 as viewed from the nip N of the fixing device 20 when the movable guide 40 is rotated to the first position P1. The airflow direction changing surface 41S is formed so that the extension surface S is disposed on the side opposite to the fan 70 as viewed from the nip N of the fixing device 20 when the movable guide 40 is rotated to the second position P2.

When the movable guide 40 is rotated to the first position P1, the extension surface S of the airflow direction changing surface 41S is disposed on the same side as the fan 70 as viewed from the nip N of the fixing device 20. Therefore, the forced air 76 blown out from the fan 70 hits the airflow direction changing surface 41S, changes the course thereof, and is less likely to flow toward the nip N of the fixing device 20. When the movable guide 40 is rotated to the second position P2, the extension surface S of the airflow direction changing surface 41S is disposed on the side opposite to the fan 70 as viewed from the nip N of the fixing device 20. Therefore, the forced air 76 blown out from the fan 70 hits the airflow direction changing surface 41S, changes the course thereof, and is likely to flow toward the nip N of the fixing device 20. Therefore, at the second position P2, the cooling efficiency of the fixing device 20 is higher than that at the first position P1.

The movable guide 40 switches the sheet discharge direction at the first position P1 and the second position P2. The image forming apparatus 100 uses the movable guide 40 for switching the sheet discharge direction and guides the air blown out from the fan 70 to the fixing device 20. Therefore, cost increase of the image forming apparatus 100 can be prevented.

The fixing device 20 is capable of executing the decolorable toner fixing mode for fixing the decolorable toner capable of being decolored as the recording agent to the sheet. The control unit 50 cools the fixing device 20 with the fan 70 when transitioning to the decolorable toner fixing mode. The temperature of the fixing device in the decolorable toner fixing mode is lower than the temperature of the fixing device in any other active operating mode. The image forming apparatus 100 can efficiently cool the fixing device 20 when transitioning to the decolorable toner fixing mode.

The control unit 50 stops cooling of the fixing device 20 by the fan 70 when the temperature of the fixing device is the fan stop temperature which is set between the decoloring lower limit temperature at which the decolorable toner can be decolored and the fixing lower limit temperature at which the decolorable toner can be fixed, when switching from a mode other than the decolorable toner fixing mode to the decolorable toner fixing mode. Therefore, in the decolorable toner fixing mode, the temperature of the fixing device 20 is not lower than the fixing lower limit temperature. Therefore, the image forming apparatus 100 can prevent excessive cooling of the fixing device 20.

The fixing device 20 includes the heat roller 21 and the control unit 50 can rotate the heat roller 21 when the fixing device 20 is being cooled by the fan 70. The heat roller 21 is also cooled by rotating. Therefore, the image forming apparatus 100 can efficiently cool the fixing device 20.

In the above-described example, the image forming apparatus 100 adopts the movable guide 40 for switching the sheet discharge direction as the guide unit 4. However, the image forming apparatus 100 can instead adopt as a guide unit a component that is capable of switching the disposition of the first position and the second position (position at which the air blown out from the fan 70 is guided to the fixing device 20) and guiding the sheet to be carried besides the movable guide 40 for switching the discharge direction.

In the guide unit 4, the movable guide 40 is urged to the first position P1 by a spring and control unit 50 moves the movable guide 40 to the second position P2 against this urging force of the spring by operating the movable guide driving solenoid 60. However, in some examples, the movable guide 40 may be urged to the second position P2 by a spring. In this case, the control unit 50 moves the movable guide 40 to the first position P1 against the urging force of the spring by operating the movable guide driving solenoid 60.

In the above-described example, the image forming apparatus 100 adopts a fan 70 as the cooling device. However the image forming apparatus 100 can instead, or in addition, adopt a cooling device for cooling the fixing device other than a fan 70.

In FIG. 7, the first fan 70*a* and the second fan 70*b* are disposed asymmetrically with respect to the center of the heat roller 21 in the X direction. However, if there is no particular restriction on the space, the first fan 70*a* and the second fan 70*b* may be disposed symmetrically with respect to the center of the heat roller 21 in the X direction.

As described above, the temperature of the fixing device in the decolorable toner fixing mode is lower than the temperature of the fixing device in the decolorable toner decoloring mode. The image forming apparatus 100 can efficiently cool the fixing device 20 when transitioning from the decolorable toner decoloring mode to the decolorable toner fixing mode. In general, the temperature of the fixing device in the decolorable toner fixing mode will be lower than the temperature of the fixing device in the non-decolorable toner fixing mode. The image forming apparatus 100 can efficiently cool the fixing device 20 even when transitioning from the non-decolorable toner fixing mode to the decolorable toner fixing mode.

The temperature of the fixing device in the non-decolorable toner fixing mode may be higher than the fixing upper limit temperature (so-called high temperature offset). The image forming apparatus 100 can efficiently cool the fixing device 20 even when the fixing device must be cooled to eliminate the high temperature offset of the fixing device.

Modification examples will be described.

As described above, the image forming apparatus 100 cools the fixing device 20 by driving the fan 70 when transitioning from the decolorable toner decoloring mode to the decolorable toner fixing mode. On the other hand, an image forming apparatus 100 in a modification example cools a fixing device 20 by driving a fan 70 during execution of operations of each mode. For example, the fixing device 20 may be cooled by driving the fan 70 during execution of operations in the decolorable toner fixing mode.

When a user instructs a printing job using a decolorable toner at the control panel 120, the image forming apparatus 100 enters the decolorable toner fixing mode. In this mode, the image forming apparatus 100 carries a sheet to the fixing device 20 after a toner image has been formed on the sheet with the decolorable toner. The image forming apparatus 100 heats the decolorable toner to a fixing temperature to fix the decolorable toner image to the sheet. When a sheet discharge tray is selected as a sheet discharge direction in the printing job, as illustrated in FIG. 4, the image forming apparatus 100 positions the movable guide 40 at the first position P1. The sheet sent out from the fixing device 20 is carried to a first carrying path 71 and is discharged to the sheet discharge tray.

The control unit 50 detects the temperature of the heat roller 21 using the HR thermistor 24 during execution of the printing job. The temperature of the heat roller 21 may exceed some predetermined temperature (e.g., a fan driving temperature) which is set in advance during the executing of the printing job. In this case, the control unit 50 cools the fixing device 20 by driving the fan 70. The image forming apparatus 100 cools the fixing device 20 while executing the printing job in which the sheet will eventually be discharged to the sheet discharge tray. That is, as illustrated in FIG. 4, the control unit 50 drives the fan 70 with the movable guide 40 disposed at the first position P1. A large gap is not formed but a small gap is still formed between the movable guide 40 at the first position P1 and the fixing guide 34. Therefore, even if the fan 70 is driven with the movable guide 40 disposed at the first position P1, some of the air blown out from the fan 70 still reaches the fixing device 20. Therefore, the image forming apparatus 100 can cool the fixing device 20 while in decolorable toner fixing mode.

As illustrated in FIG. 4, the image forming apparatus 100 of the modification example drives the fan 70 in a state where the movable guide 40 is disposed at the first position P1 and cools the fixing device 20. On the other hand, as illustrated in FIG. 5, the image forming apparatus 100 drives the fan 70 in a state where the movable guide 40 is disposed at the second position P2 and can cool the fixing device 20.

The image forming apparatus 100 of the modification example cools the fixing device by driving the fan 70 during execution of operations in the decolorable toner fixing mode. The image forming apparatus 100 can also cool the fixing device 20 by driving the fan 70 during execution of operations in the non-decolorable toner fixing mode or the decolorable toner decoloring mode A first comparative example will be described.

The image forming apparatus 100 cools the fixing device 20 by driving the fan 70. On the other hand, an image forming apparatus of the comparative example is configured to cool a component other than a fixing device 20 by driving a fan 70. The image forming apparatus of the first comparative example may operate the fan 70 based on the measured temperature of the fan 70 itself with no particular reference to a temperature of another component in the image forming apparatus.

The fan 70 may be at a higher temperature during execution of the decolorable toner decoloring mode. In this case, the control unit 50 drives the fan 70 to lower the detected temperature of the fan 70. The control unit 50 detects the temperature of the fan 70 by a fan temperature sensor and drives the fan 70 when the detected temperature is equal to or greater than a predetermined temperature. The air blown out from the fan 70 hits the movable guide 40, similar to in manner to that illustrated in FIG. 4, and some air thus returns to the fan 70. Therefore, the image forming apparatus can cool the fan 70 by driving the fan 70.

A second comparative example will be described.

An image forming apparatus of the second comparative example cools a sheet by driving fan 70.

In the decolorable toner decoloring mode, the image forming apparatus carries a sheet to a fixing device 20 and heats the decolorable toner to a decoloring temperature to decolor an image on the sheet. In this case, the control unit 50 sets the temperature of a heat roller 21 to the decoloring temperature. In general, since the decoloring temperature is higher than a fixing temperature, the sheet (and the decolored toner thereon) is at a high temperature. When the sheet is discharged and another, subsequent sheet is accumulated on top of the previous sheet in the sheet discharge tray, a sticking of adjacent sheets in the discharge tray via the still warm toner may occur.

Therefore, the image forming apparatus cools the sheet by driving the fan 70 during execution of the decolorable toner decoloring mode. The control unit 50 detects the temperature of the sheet using a sheet temperature sensor and drives the fan 70 when the temperature of the sheet is equal to or greater than a predetermined temperature. Similar in manner to that illustrated in FIG. 4, the control unit 50 drives the fan 70 with the movable guide 40 disposed at the first position P1. Therefore, the image forming apparatus 100 cools the sheet carried along a first carrying path 17 after the fixing device 20. A large gap is not formed but there is still a small gap between the movable guide 40 at the first position P1 and the fixing guide 34. Therefore, even if the fan 70 is driven with the movable guide 40 disposed at the first position P1, some of the air blown out from the fan 70 reaches the first carrying path 17. Therefore, the image forming apparatus can cool the sheet while executing the decolorable toner decoloring mode.

Similar in the manner illustrated in FIG. 4, the image forming apparatus of the second comparative example drives the fan 70 in a state where the movable guide 40 is disposed at the first position P1, and cools the sheet carried along the first carrying path 17. On the other hand, as illustrated in FIG. 5, the image forming apparatus 100 drives the fan 70 in a state where the movable guide 40 is disposed at the second position P2, and can cool the sheet carried along a second carrying path 72. The image forming apparatus of the comparative examples cool the fan 70 itself or the sheet by driving the fan 70. However, the image forming apparatus 100 according to an embodiment of the present disclosure can cool another aspect by driving the fan 70.

According to at least one embodiment described above, the fixing device 20 can be efficiently cooled by providing the control unit 50 that is configured to cause the movable guide 40 to be disposed at the second position P2 by which the forced air from the fan 70 is guided to the fixing device 20 so that the fixing device 20 can be cooled by the fan 70 more efficiently.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a fixing device configured to fix a toner to a recording medium;

a cooling device disposed so as to cool the fixing device with forced air;

a rotatable guide configured to guide the recording medium towards a first location in a first position and towards a second location when in a second position, the rotatable guide partially blocking the forced air in the first position and forming a pathway for the forced air between the cooling device and the fixing device when at the second position; and a control unit configured to rotate the guide unit to the second position if an operating mode of the fixing device is changed from a first mode in which the fixing unit has a set point temperature at a first temperature to a second mode in which the fixing unit has a set point temperature at a second temperature lower than the first temperature.

2. The image forming apparatus according to claim 1, wherein the cooling device is a fan.

3. The image forming apparatus according to claim 1, wherein the cooling device comprises a plurality of fans.

4. The image forming apparatus according to claim 1, wherein the first mode is a decoloring mode and the first temperature is a decoloring temperature of a decolorable toner.

5. The image forming apparatus according to claim 4, wherein the second mode is a printing mode for the decolorable toner and the second temperature is a fixing temperature of the decolorable toner.

6. The image forming apparatus according to claim 1, wherein the rotatable guide comprises:

a connecting bar, and a plurality of guide blades attached to the connecting bar to form a comb-like shape.

7. The image forming apparatus according to claim 6, wherein at least one guide blade in the plurality has an airflow directing surface configured to direct forced air from the cooling device towards the fixing device when the rotatable guide is at the second position.

8. The image forming apparatus according to claim 6, further comprising:

a fixing device guide having a comb-like shape disposed to mesh with the plurality of guide blades when the rotatable guide is in the first position.

9. The image forming apparatus according to claim 1, further comprising a temperature sensor configured to sense a temperature of a pressing belt in the fixing device and supply the sensed temperature to the control unit.

10. The image forming apparatus according to claim 9, wherein the control unit is further configured to rotate the rotatable guide to the second position when the sensed temperature exceeds a threshold value.

11. An image forming apparatus, comprising:

a fixing device configured to fix a toner to a recording medium;

a cooling device configured to cool the fixing device with forced air;

a rotatable guide configured to control a travel direction of the recording medium and to change a direction of the forced air from the cooling device; and a control unit configured to rotate the guide unit between a first position and a second position, wherein cooling efficiency of the fixing device due to the forced air is greater with the guide unit at the second position than at the first position.

12. The apparatus according to claim 11, wherein the guide unit includes an airflow direction changing surface that changes a direction of the forced air from the cooling device, the airflow direction changing surface guides the forced air towards a nip portion of the fixing device when the guide unit is at the second position, and the airflow direction changing surface at least partially blocks the forced air between the cooling device and the nip portion when the guide unit is at the first position.

13. The apparatus according to claim 11, wherein the guide unit is configured to switch a discharge direction of the recording medium by switching between the first and second positions.

14. The apparatus according to claim 11, wherein the fixing device can be operated in a decolorable toner fixing mode for fixing a decolorable toner to the recording medium, and the control unit is configured to cool the fixing device in the transition from any mode other than the decolorable toner fixing mode to the decolorable toner fixing mode.

15. The apparatus according to claim 14, wherein the control unit is configured to stop cooling the fixing device when a temperature of the fixing device reaches a cooling device stop temperature, which is set in advance, and is between a decoloring lower limit temperature at which the decolorable toner can be decolored and a fixing lower limit temperature at which the decolorable toner can be fixed.

16. The apparatus according to claim 11, wherein the fixing device includes a heated roller that heats the recording medium, and the control unit is configured to rotate the heated roller when the fixing device is being cooled.

17. A method of controlling an image forming apparatus that forms images on sheets with decolorable and non-decolorable toner, the method comprising:

when transitioning from a first operating mode in which a fixing device is set to a first temperature to a second operating mode in which the fixing device is set to a second temperature that is lower than the first temperature, causing a cooling device to emit forced air and rotating a rotatable guide from a first position at which the rotatable guide at least partially blocks the forced air from the cooling device from reaching the fixing device to a second position at which the rotatable guide opens a path for the forced air between the cooling device and the fixing device, wherein the rotatable guide in the first position functions to direct the recording medium to a discharge tray and the rotatable guide in the second position functions to direct the recording medium to destination other than the discharge tray.

18. The method of claim 17, further comprising:

rotating a fixing element in the fixing device during the transitioning.

19. The method of claim 17, wherein the rotatable guide is configured to direct the forced air towards the fixing device when disposed in the second position.

* * * * *